US007384498B2

(12) United States Patent
Rannikko

(10) Patent No.: US 7,384,498 B2
(45) Date of Patent: Jun. 10, 2008

(54) CARPET REMOVAL SYSTEM AND METHOD

(76) Inventor: John Rannikko, P.O. Box 140, Auburn, MA (US) 01501

( * ) Notice: Subject to any disclaimer, the term of this patent is extended or adjusted under 35 U.S.C. 154(b) by 495 days.

(21) Appl. No.: 11/241,785

(22) Filed: Sep. 30, 2005

(65) Prior Publication Data

US 2006/0180799 A1 Aug. 17, 2006

Related U.S. Application Data

(60) Provisional application No. 60/615,545, filed on Sep. 30, 2004.

(51) Int. Cl.
*B32B 38/10* (2006.01)
*B66D 1/00* (2006.01)

(52) U.S. Cl. ..... 156/344; 156/584; 254/202; 254/213; 254/227; 294/103.1

(58) Field of Classification Search ..... 156/344, 156/584; 254/199, 200, 202, 203, 208, 213, 254/227, 242, 262; 294/8.6, 103.1, 104, 294/119.1, 902; 269/53, 54.5; 16/5
See application file for complete search history.

(56) References Cited

U.S. PATENT DOCUMENTS 4,533,118 A * 8/1985 Thomas et al. ..... 254/202
4,560,146 A * 12/1985 Thomas et al. ..... 254/202
5,454,899 A * 10/1995 Glenn et al. ..... 156/584
5,456,794 A * 10/1995 Barrett ..... 156/584
5,505,433 A 4/1996 Carmichael et al.
6,455,812 B1 * 9/2002 Houle ..... 219/228
7,032,886 B1 * 4/2006 Kraft ..... 254/200
2004/0069980 A1 * 4/2004 Shannon ..... 254/202
2007/0246167 A1 * 10/2007 Goupil ..... 156/584

OTHER PUBLICATIONS

Flooring Toold and Equipment, National Flooring Equipment Catalog 2004, nationalequipment.com.

* cited by examiner

*Primary Examiner*—Mark A Osele
(74) *Attorney, Agent, or Firm*—Hamilton, Brook, Smith & Reynolds, P.C.

(57) ABSTRACT

A carpet removal or stripping method and system (machine) employs a common dolly. The backside of the dolly member has a plurality of teeth. A motorized winching system is coupled to the front side of the dolly member. A dual purpose safety shield covers the teeth during transportation and serves as a protective screen for the user during carpet removal operation of the invention machine. The winching system automates carpet peeling activity with the dolly member lying backside down during operation, and the teeth provide an anchoring effect. A pull bar removably grasps the subject carpet. A cable is coupled between the winching system and the pull bar. The winching system takes up or pulls the cable and hence the pull bar, such that the carpet is peeled away and separated from the subfloor.

20 Claims, 5 Drawing Sheets

CARPET REMOVAL SYSTEM AND METHOD

RELATED APPLICATIONS

This application claims the benefit of U.S. Provisional Application No. 60/615,545 filed Sep. 30, 2004, the entire teachings of which are incorporated herein by reference.

BACKGROUND OF THE INVENTION

In the flooring industry, carpet is typically installed from 12-foot wide rolls or in one foot square carpet "tiles". The carpet material is glued and/or tacked to the subfloor. It is a laborious task to remove such installed carpeting. There are limited tools for assisting with carpet removal, especially for homeowner use in the residential setting.

There is a motorized tool/machine for removing carpet tiles and other tiles in an industrial setting by National Flooring Equipment of Minneapolis, Mo. Further National Flooring Equipment provides an industrial carpet lifting or pulling machine that utilizes a ¾ horsepower electric motor.

Other carpet removal tools are not automated or motorized such as in U.S. Pat. No. 5,505,433 to Carmichael et al.

SUMMARY OF THE INVENTION

Thus there is a need for a carpet removing or stripping machine that improves over the prior art.

The present invention provides a system and method that addresses the needs and problems of the prior art. The present invention provides a motorized mechanism for lifting or peeling carpet off the glued surface resulting in carpet removal. In a preferred embodiment, the present invention includes a dolly member carrying an electric winch and having a plurality of teeth protruding from a back surface of the dolly member for anchoring or stabilizing the invention machine in place during operation. A dual purpose safety screen serves as a cover over the teeth during transportation of the invention machine, and during operation of the invention machine, the safety screen shields the user from potential airborne debris.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
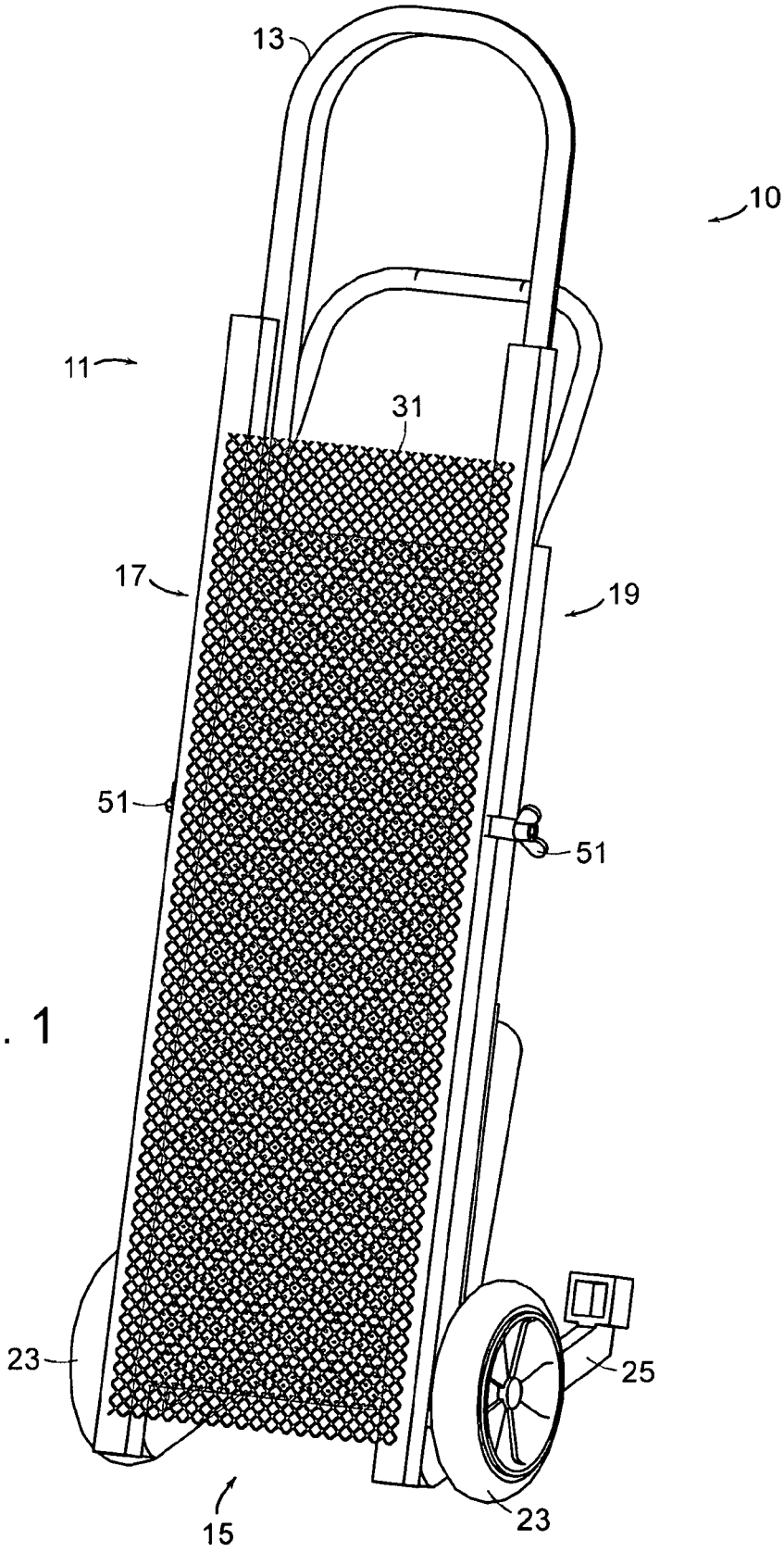
FIG. 1 is perspective view of a preferred embodiment of the present invention in transportation mode.
Figure 2:
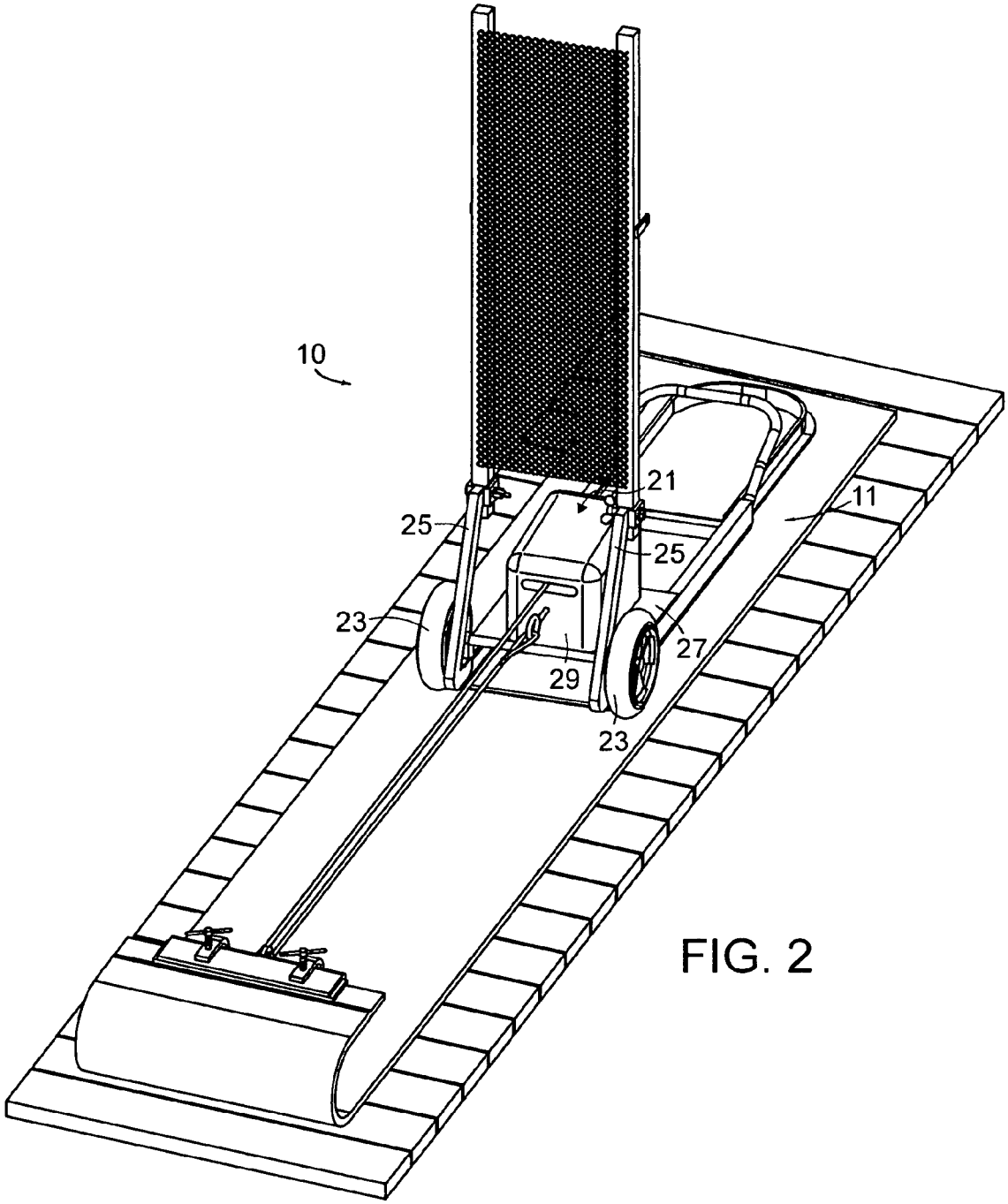
FIGS. 2 and 3 are perspective views of the embodiment of FIG. 1 but in use or operational mode and including a pull bar.
Figure 3:
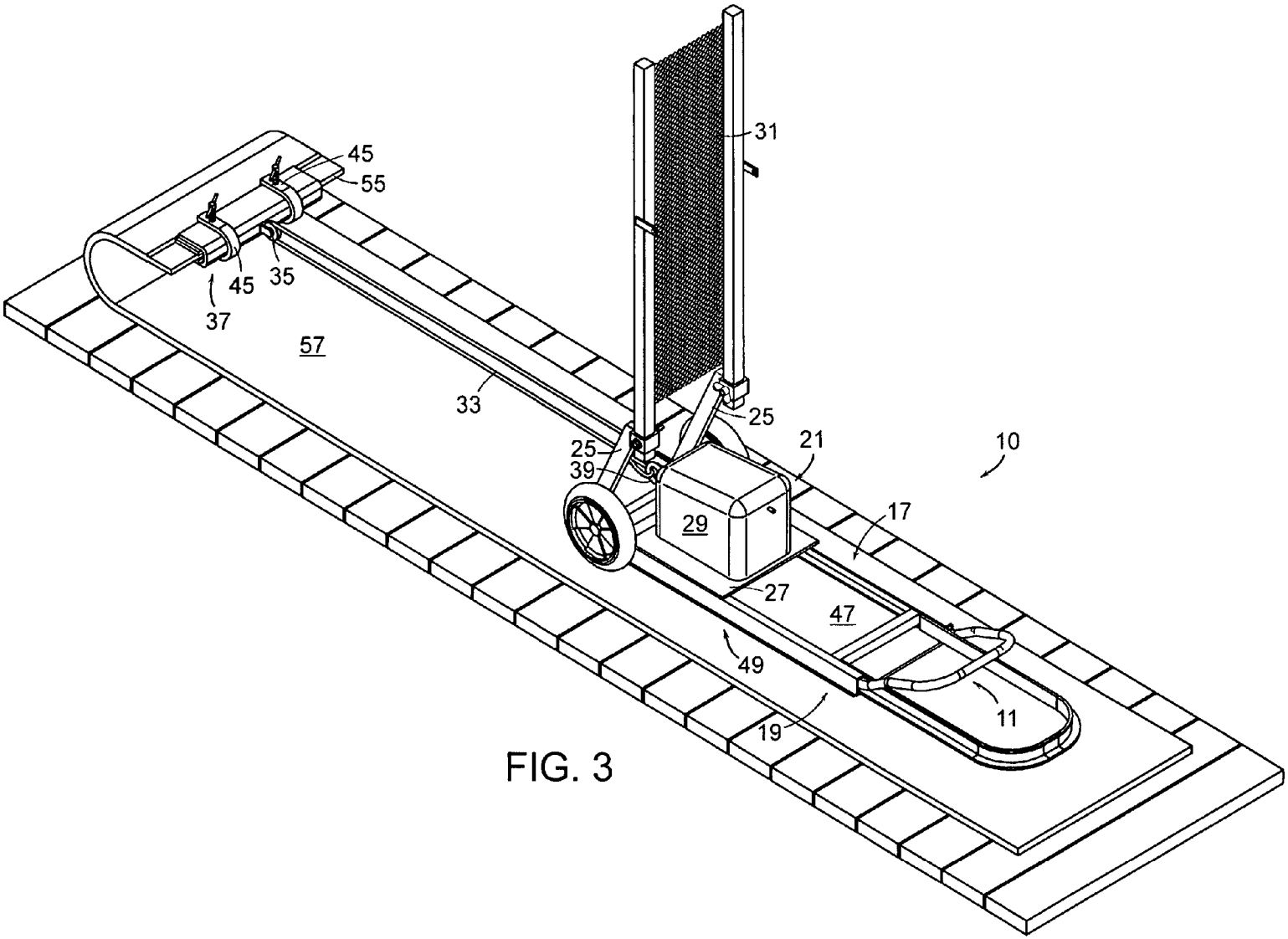

Illustrated in FIGS. 1-3 is one embodiment of the present invention. Generally the illustrated machine 10 is formed of a main dolly-like member 11, a motorized winching system 21, and a safety shield 31 that has a dual purpose. Each of these components or subsystems is described in more detail below.

The main dolly-like member 11 has a one foot wide main body (frame) with a handle proximal end 13 opposite a distal foot end 15. Between the proximal 13 and distal 15 ends are front face (side) 17 and opposite back face (side) 19 of the main body/frame. Wheels 23 are attached to the foot end 15 of the main body enabling the invention machine 10 to be mobile (movable under user control). Two prongs 25 protrude from main body front face 17 at the foot end 15.

In a preferred embodiment dolly member 11 (including main body, prongs 25 and wheels 23) is a Magliner aluminum dolly with two 8 inch wheels. Other dollies or similar assemblies with common dimensions may be used.

Coupled to the front side 17 between prongs 25 is a motorized winching system 21. In a preferred embodiment, the winching system 21 includes a Dayton 2K pound capacity electric winch 29 with a 5/16 inch diameter aircraft (steel) or similar material cable 33 as shown in FIGS. 2 and 3. The electric powered winch 29 is bolted to a steel plate 27 that is fixed to the front side 17 of the dolly member 11. Steel plate 27 is preferably ¼ inch thick and about 1 foot wide by 15 inches long. Other dimensions for steel plate 27 are suitable.

Cable 33 of the winching system 21 is about 20 feet long or longer in the preferred embodiment. One end of the cable 33 is connected to the winch pulling or take-up mechanism while the opposite end is connected to a clasping hook 39 or similar connector. The clasping hook 39 is either threaded through or removably coupled to an appropriate loop 35 of pull bar 37 (FIG. 3).

Figure 4:
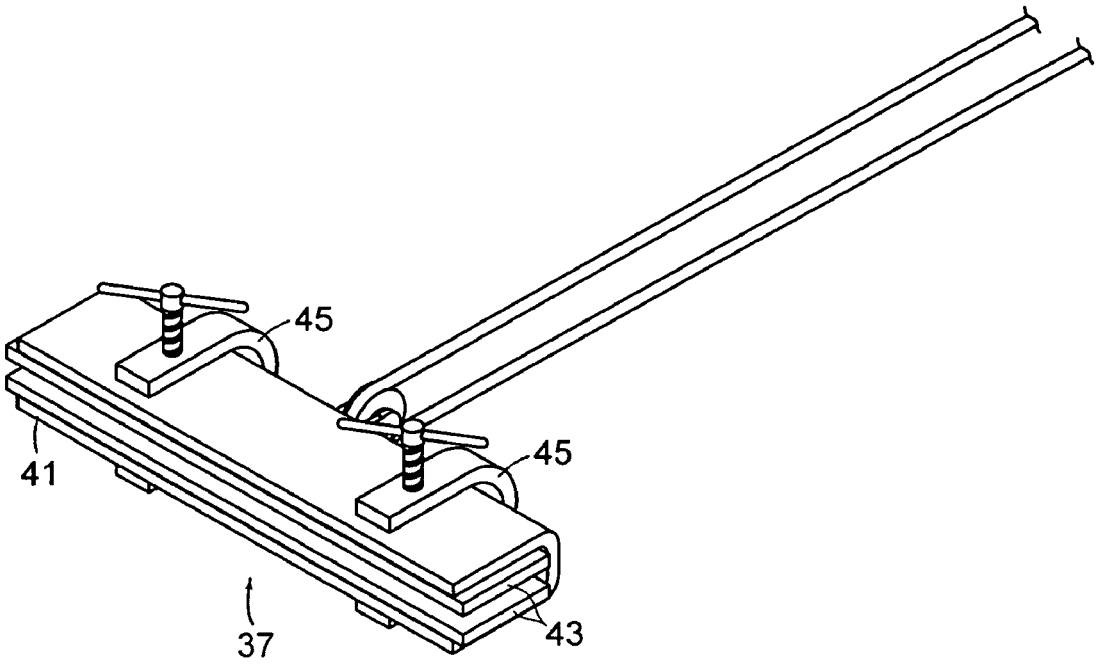
FIG. 4 is a perspective view of the pull bar in the embodiment of FIGS. 2 and 3.
Figure 5:
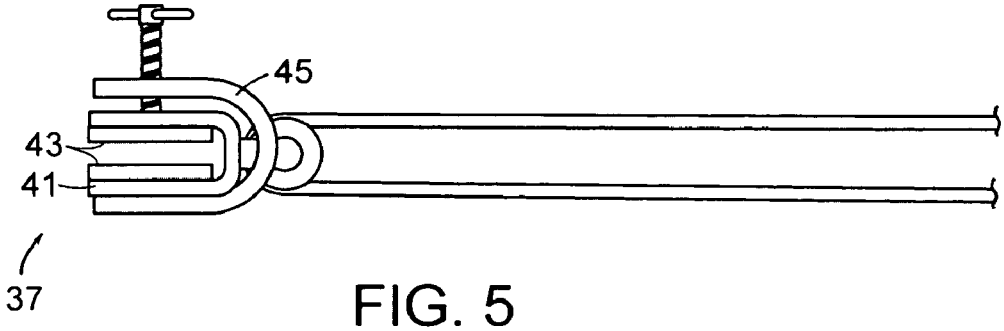
FIG. 5 is a side view of the pull bar of FIG. 4.

In a preferred embodiment shown in FIGS. 4 and 5, pull bar 37 is formed of a 1¾ inch thick U-shaped piece of steel 41 with two plates 43 of 1½ inch square stock fitted into the opening of the U-shape. Two or more C clamps 45 (or other clamps) are welded to the U-shaped steel piece 41 and spaced apart along the length of the pull bar 37. A carpet edge 55 (FIG. 3) is insertable into the opening of the U-shape and clamped between the plates 43 upon tightening of the C clamps 45. Pull bar 37 may be of various lengths. Applicant prefers the use of a 2 foot long pull bar 37 for doorway and other relatively narrow areas and a 4 foot long pull bar 37 for other areas of use.

Figure 6:
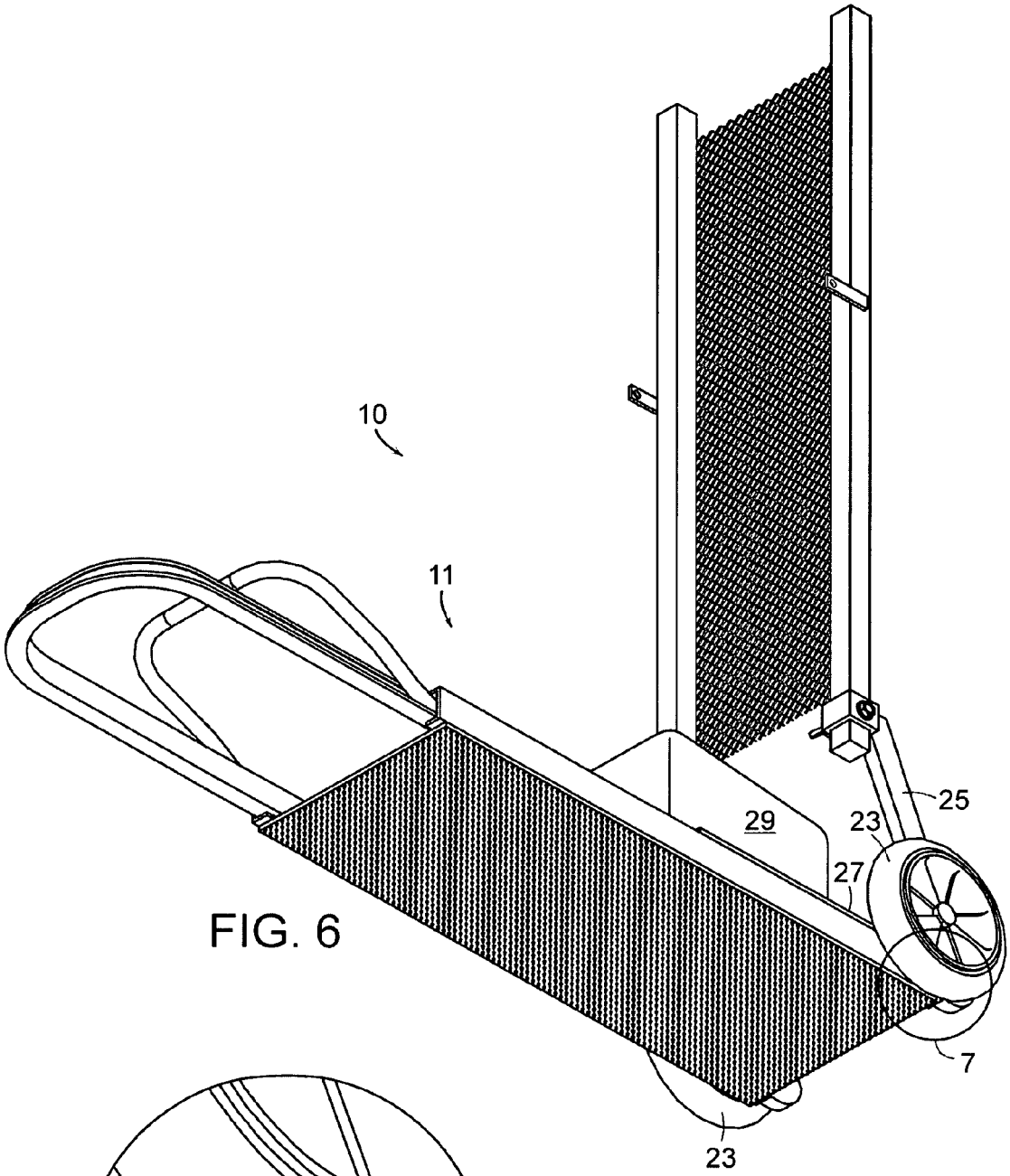
FIG. 6 is a bottom perspective view of the embodiment of FIGS. 2 and 3.
Figure 7:
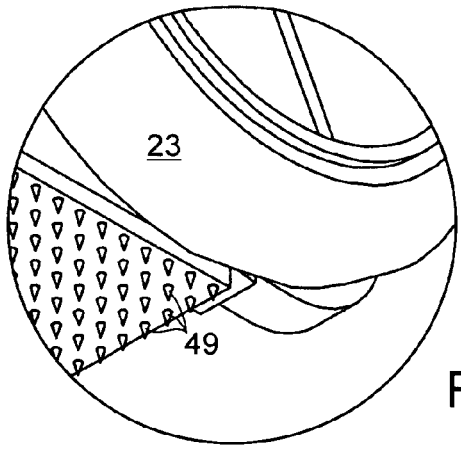
FIG. 7 is a partial view of FIG. 6 at the circled inset.

Referring back to FIG. 3, the back side 19 of the dolly member 11 is lined with a ¼ inch thick steel plate 47 (about 1 foot wide by 44 inches long in the preferred embodiment). Steel liner plate 47 is bolted or otherwise fixed to the dolly 11 frame. As illustrated in FIGS. 6 and 7, framing plates with a plurality of ¾ inch long or longer teeth 49 are fixedly attached to the steel liner plate 47 such that the teeth 49 protrude out and away from the back side 19 of dolly member 11. In a preferred embodiment, the invention machine 10 has over 3000 such teeth 49. In contrast, the carpet pulling tools in the prior art have about ⅓ or fewer number of teeth and smaller sized teeth which have proven not to grip well so that the prior art machines tend to slide during operation which poses a safety hazard and a performance loss.

During storage (times of non-use) and transportation of the invention machine 10, safety shield 31 serves as a protective cover over teeth 49 as shown in FIG. 1. This protects the user from the sharp teeth 49 as well as protects truck surfaces or other exposed surfaces from being scratched or gouged by the teeth 49. Safety shield 31 is a framed 1 foot by 5 foot metal screen removably bolted to the dolly frame. For example, in one embodiment, two wing nut bolts 51 (FIG. 1) hold safety shield 31 onto the back side 19 of the dolly member 11.

Thus during transportation and upon arrival at the desired site for use of the invention machine 10, safety shield 31 is in teeth 49 covering position as shown in FIG. 1. The invention machine 10 is safely and easily handled and maneuvered just like a typical dolly. The invention machine 10 being only about 1 foot wide overall (the width of main dolly member 11) easily fits through doorways and passages in a house setting, for example (as opposed to industrial/commercial settings in the prior art).

Once the user has wheeled the invention machine 10 to the desired location for carpet removal, the safety shield 31 is removed from the dolly member back side 19 and removably attached (i.e., bolted) on end to the dolly prongs 25. See FIGS. 2, 3 and 6. The invention machine 10 is placed in operating position by laying the dolly member back 19 and teeth 49 side down on the carpet (the safety shield 31 no longer covering the teeth). The teeth 49 under the weight of the invention machine 10 have an anchoring effect and stabilize (make stationary) the invention machine 10 during operation.

The winch cable 33 is uncoiled and the clasping hook end 39 is either strung through or removably attached to a loop 35 of a desired pull bar 37. If the clasping hook 39 is strung through loop 35 then the cable 33 is doubled back to the winch unit 29 where the clasping hook 39 is secured (connected) appropriately. An exposed edge 55 of the subject carpet 57 is placed into the opening of the pull bar 37 and the pull bar 37 is made to securely grip the carpet edge 55 as previously described in FIGS. 4 and 5. Once the pull bar 37 is secured onto the subject carpet edge 55, the user can operate the winch 29 to pull the pull bar 37 and thus pull (or peel) the carpet 57 off the subfloor toward the anchored invention machine 10. During this operation, the user stands behind the safety shield 31 now in its user screening position. In this mode, the safety shield 31 provides an effective area of protection for the user to stand in. The effective area of protection is about 1 foot wide by 5 feet high, which is an improvement over the prior art dimensions for safety shielding. The safety shield 31 being of screen material allows the user to view the carpet pulling activity (of the winch 29 and pull bar 37) while being shielded from any airborne debris. Where the cable 33 is of a material that will not stretch or bind, there is reduced danger of any snap back should the cable break. Further, the cable 33 in the preferred embodiment is of material proven to unlikely break. The safety shield 31 provides added protection in the event of the cable breaking during operation of the invention machine 10. Such is not the case in the prior art tools.

Accordingly, the present invention provides a relatively light weight motorized carpet removal machine 10 usable especially by the homeowner or in the residential setting. A safety shield 31 duals as a cover to the teeth side 49 of the invention machine 10 and a safety screen for the user to stand behind during operation of the invention machine 10. Such a carpet removal machine has heretofore been unachieved by the prior art.

While this invention has been particularly shown and described with references to preferred embodiments thereof, it will be understood by those skilled in the art that various changes in form and details may be made therein without departing from the scope of the invention encompassed by the appended claims.

For example, the foregoing description includes various dimensions for purposes of illustration and not limitation of the present invention. Similarly, material of the various parts is specified for purposes of illustration and not limitation of the present invention.

In another example, the electric winch 29 may be remotely controlled and/or powered by a battery pack as opposed to AC current. Other motorized winches and power sources for the same are suitable.

Where bolts and hooks are mentioned, it is understood that other fasteners and connectors are suitable and in the purview of one skilled in the art given this disclosure.

What is claimed is:

1. A carpet removal system comprising:

a dolly member having a front side and back side opposite the front side, the back side bearing a plurality of teeth;

a motorized winching system coupled to the front side of the dolly member; and a safety shield that covers the teeth during transportation and serves as a protective screen for the user during carpet removal operation of the system, the winching system enabling automated carpet peeling activity with the dolly member lying backside down during operation and the teeth providing an anchoring effect.

2. A carpet removal system as claimed in claim 1 wherein the dolly member has prongs protruding from the front side; and the safety shield is removably attached to the prongs to serve as a protective screen for the user during carpet removal operation.

3. A carpet removal system as claimed in claim 1 further comprising a pull bar removably grasping a subject carpet; and the winching system includes a cable removably coupled to the pull bar, during operation, the winching system taking up the cable and hence the pull bar such that the subject carpet is peeled away from a subfloor.

4. A carpet removal system as claimed in claim 3 wherein the pull bar has a length between about 2 feet and 4 feet.

5. A carpet removal system as claimed in claim 1 wherein the dolly member is a common dimensioned dolly, such that the carpet removal system fits through residential passageways and doorways.

6. A carpet removal system as claimed in claim 1 wherein the winching system includes an electric winch.

7. A carpet removal system as claimed in claim 6 wherein the electric winch is attached to a plate that is secured to the front side of the dolly member.

8. A carpet removal system as claimed in claim 1 wherein the plurality of teeth are provided by a plurality of framing plates lining the back side of the dolly member.

9. Given carpet affixed to a subfloor, a method for separating the carpet from the subfloor comprising the steps of:

providing a dolly member having a front side and back side opposite the front side, the back side bearing a plurality of teeth;

coupling a motorized winching system to the front side of the dolly member;

covering the teeth with a safety shield during transportation of the dolly member and using the safety shield as a protective screen for the user during operation of the winching system; and operating the winching system to automate carpet peeling activity with the dolly member lying backside down during operation and the teeth providing an anchoring effect.

10. A method as claimed in claim 9 wherein the dolly member has prongs protruding from the front side; and the safety shield is removably attached to the prongs to serve as a protective screen for the user during carpet removal operation.

11. A method as claimed in claim 9 further comprising the step of using a pull bar, removably grasping a subject carpet; and removably coupling a cable between the pull bar and the winching system, during operation, the winching system taking up the cable and hence the pull bar such that the subject carpet is peeled away from a subfloor.

12. A method as claimed in claim 11 wherein the pull bar has a length between about 2 feet and 4 feet.

13. A method as claimed in claim 9 wherein the dolly member is a common dimensioned dolly, such that the carpet removal system fits through residential passageways and doorways.

14. A method as claimed in claim 9 wherein the winching system includes an electric winch.

15. A method as claimed in claim 9 wherein the plurality of teeth are provided by a plurality of framing plates lining the back side of the dolly member.

16. Carpet removal apparatus comprising:

dolly means having a front side and back side opposite the front side, the back side including anchoring means;

winching means coupled to the front side of the dolly member; and a dual purpose shield means for covering the anchoring means during transportation and serving as a protective screen for the user during carpet removal operation of the apparatus, the winching means enabling automated carpet peeling activity with the dolly member lying backside down during operation and providing an anchoring effect.

17. Apparatus as claimed in claim 16 wherein the anchoring means includes a plurality of teeth.

18. Apparatus as claimed in claim 16 wherein the dolly member has prongs protruding from the front side; and the dual purpose shield means is removably attached to the prongs to serve as a protective screen for the user during carpet removal operation.

19. Apparatus as claimed in claim 16 further comprising a pull bar removably grasping a subject carpet; and the winching means includes a cable removably coupled to the pull bar, during operation, the winching means taking up the cable and hence the pull bar such that the subject carpet is peeled away from a subfloor.

20. Apparatus as claimed in claim 16 wherein the winching means includes a motorized winch.

* * * * *